United States Patent [19]

Lutz

[11] Patent Number: 4,712,699

[45] Date of Patent: Dec. 15, 1987

[54] PACKAGE EMPLOYING UNIQUE SEAL

[75] Inventor: Michael Lutz, Watchung, N.J.

[73] Assignee: Captive Plastics, Inc., Piscataway, N.J.

[21] Appl. No.: 914,384

[22] Filed: Oct. 2, 1986

[51] Int. Cl.[4] ..... B65D 53/00

[52] U.S. Cl. ..... 215/329; 215/307; 215/354

[58] Field of Search ..... 215/307, 329, 354, 341, 215/31

[56] References Cited

U.S. PATENT DOCUMENTS

| | | | |
|---|---|---|---|
| 1,876,152 | 9/1932 | Sheaffer | 215/329 |
| 3,592,349 | 7/1971 | Baugh | 215/307 |
| 4,253,581 | 3/1981 | Aichinger et al. | 215/354 X |
| 4,299,330 | 11/1981 | Walter | 215/329 X |

*Primary Examiner*—Donald F. Norton

*Attorney, Agent, or Firm*—Caesar, Rivise, Bernstein, Cohen & Pokotilow, Ltd.

[57] ABSTRACT

A package includes a container having an upper finish with inner and outer surfaces. The outer surface includes threads adjacent the top of the finish, and the inner surface includes a lower sealing section located solely in a section of the finish spaced downwardly from the upper margin of said finish. A closure for the container includes an inner valve having an outer sealing surface for frictionally engaging only the lower sealing section of the inner finish surface to provide a leak-proof seal for the package.

6 Claims, 2 Drawing Figures

PACKAGE EMPLOYING UNIQUE SEAL

FIELD OF THE INVENTION

This invention relates generally to a package, and more specifically to a package of the type employing a container and threaded closure therefor.

BACKGROUND ART

It goes without saying that packages intended to contain liquids and a variety of other materials should be capable of establishing a seal that is effective to prevent leakage. A packaging system which is becoming quite popular for retaining a wide variety of such materials employs an injection blow molded container, which either can be opaque, translucent or transparent, and an injection molded closure therefor. Injection blow molded containers or bottles can be made from a variety of different plastics, with a preferred plastic being a polyvinyl chloride that is formulated for use in an injection blow molding process, as is well known in the art. A threaded closure for such a bottle or container can be made of polypropylene or other similar plastic material.

One way of providing a seal for a threaded container is to employ a threaded cap with an internal liner therein. However, this introduces an additional element into the construction, and thereby introduces additional material and labor costs into the fabricating process. Moreover, in the event that the liner becomes deteriorated or otherwise worn, the sealing capabilities thereof can be adversely effected, thereby resulting in undesired leakage. Leakage also can occur when the internal pressure in the container causes the top to "dome", thereby adversely affecting the seal between the liner and the upper surface of the container. When the material being packaged is either caustic or otherwise harmful, the leakage of such a material is of a significant concern.

In order to overcome the problems associated with introducing an additional liner into the closure construction, it has been suggested to provide a threaded closure having an internal, cylindrical rib or valve for frictionally engaging the inner surface of a bottle, adjacent the upper surface of the finish thereof. However, it has been determined that the high forces needed to establish a leak-proof seal impose such high stresses in the upper region of the bottle finish that the finish of the bottle often cracks or splits. This problem has been found to be particularly acute with injection blow molded bottles made from polyvinyl chloride.

OBJECTS OF THE INVENTION

It is a general object of this invention to provide a package in which an effective seal is established between a bottle and closure thereof.

It is a more specific object of this invention to provide an effective seal between a bottle and closure, without causing the bottle to either crack or split.

It is a further object of this invention to create an effective seal between an injection blow molded bottle and a threaded closure, without causing the bottle to crack or split.

It is a more specific object of this invention to provide a package wherein a linerless closure is employed in connection with a bottle or container to establish an effective seal.

It is a further object of this invention to provide an economical and reliable packaging system for establishing an effective seal in the packaging of a wide variety of materials.

SUMMARY OF THE INVENTION

The above and other objects of this invention are achieved by a package employing a container having an upper finish including outer and inner surfaces. Threads are provided on the outer surface adjacent the top of said finish, and the inner surface of the finish has a lower sealing section located solely in a section of the finish spaced downwardly from the upper margin of the finish.

In a preferred embodiment of the invention the outer surface of the finish opposite the sealing section of the inner surface is free of threads.

Most preferably, the sealing section of the inner surface is connected to an upper section of the inner surface by an inwardly directed transition section, whereby the diameter of the finish adjacent the sealing section of the inner surface is less than the diameter of the finish adjacent the upper section of the inner surface.

In the most preferred embodiment of the invention, a junction between the transition section and the sealing section of the inner surface is located downwardly from the upper margin of the finish a distance greater than 40% of the overall height of said finish.

In the preferred package, a threaded closure is provided for being threadedly received on the finish of the bottle. The closure preferably includes an upper surface, an outer skirt extending downwardly from said upper surface, and an inner valve spaced concentrically within the outer skirt and also extending downwardly from said upper surface. Threads are provided on the inner surface of the skirt for threadedly receiving the threads on the outer surface of the finish of the bottle. The inner valve includes an outer sealing surface extending downwardly from the upper closure surface a distance sufficient for frictionally engaging only the lower sealing section of the inner finish surface to thereby provide a leak-proof seal.

Most preferably, the threads on the inner surface of the closure skirt are located to engage the threads on the finish of the bottle prior to the outer sealing surface of the inner valve frictionally engaging the lower sealing section of the inner surface of the finish. In the most preferred arrangement the lower end of the inner valve of the closure includes a lead-in section which moves into a region radially aligned with the lower sealing section of the inner surface, but without engaging said lower sealing section.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
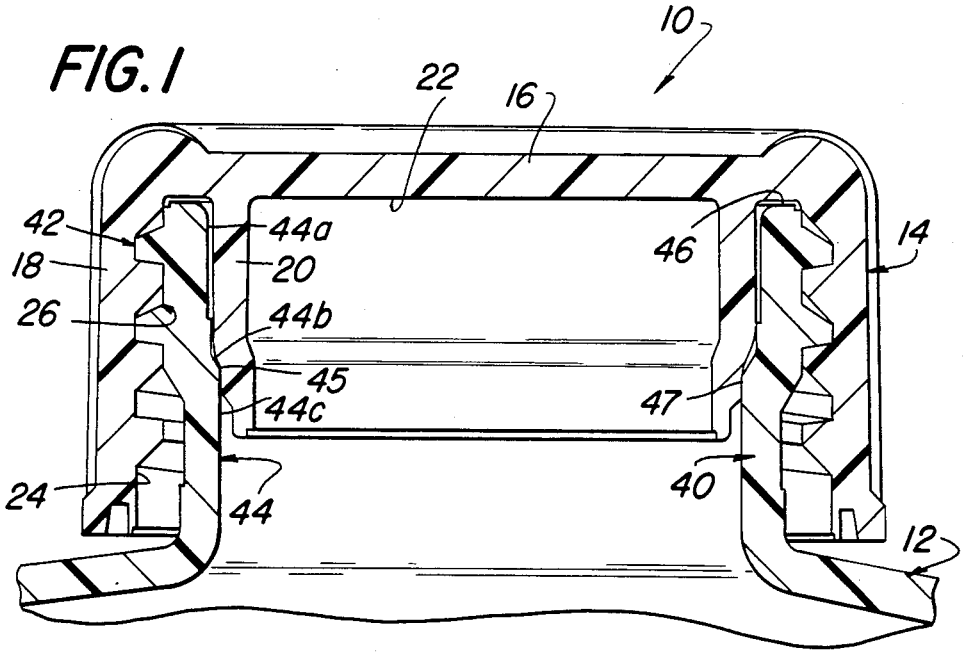
FIG. 1 is a sectional view of the upper portion of the package of this invention, showing a closure fully inserted on the finish of a bottle to provide a leak-proof, sealed connection.

Referring now in greater detail to the various figures of the drawings wherein like reference characters refer to like parts, a package embodying the present invention is generally shown at 10 in FIG. 1. The package 10 basically comprises a closure 14 for establishing a leak-proof seal with a container 12. In the most preferred embodiment of this invention the container 12 is an injection blow molded member made from polyvinyl chloride, and the closure 14 is made of polypropylene by a conventional injection molding process.

Referring to the drawings, the closure 14 includes an upper wall 16 having an outer skirt 18 extending downwardly from the periphery of said upper wall. An inner rib or valve 20 is generally cylindrical, like the outer skirt 18, and also extends downwardly from the upper wall 16 of the closure.

The upper wall 16 includes a downwardly facing surface 22 from which inner wall 24 of the outer skirt 18 extends. This inner wall includes a threaded section 26, which extends approximately 0.350 inches downwardly from the surface 22, which is approximately 80% of the length of the skirt 18, as measured from said surface 22 (the length of the skirt 18 is approximately 0.440 inches).

The inner valve 20 extends downwardly from the surface 22 of upper closure wall 16 approximately 0.310 inches, or approximately 70% of the length of the skirt 18, as measured from said surface 22. Moreover, the length of the valve 20 is approximately 90% of the length of the threaded section 26 on the inner wall 24 of the skirt.

Figure 2:
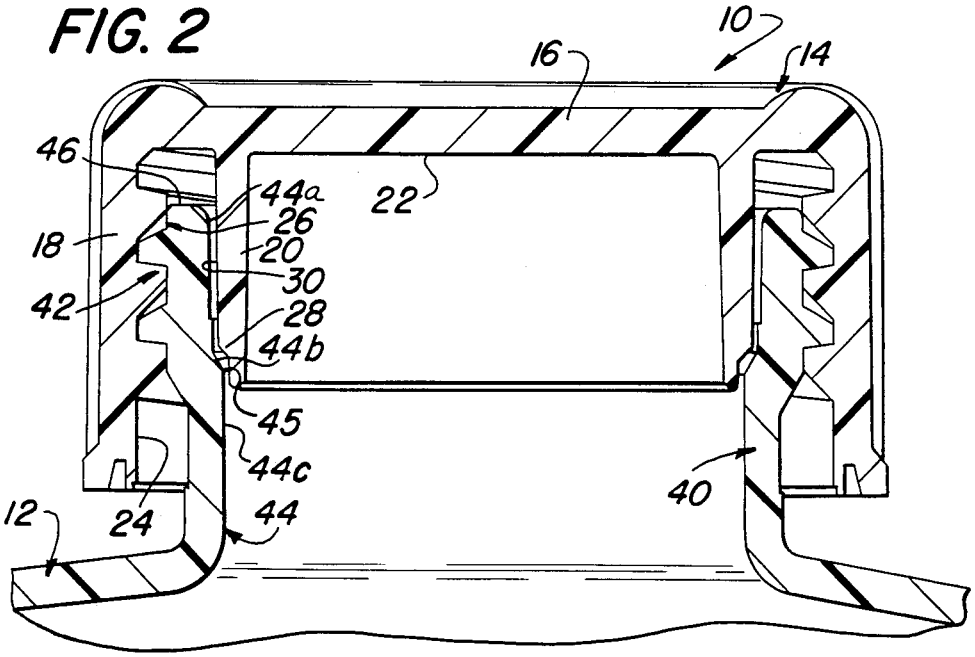
FIG. 2 is a view similar to FIG. 1 but showing the position of the closure on the finish of the bottle, just prior to establishing the leak-proof seal therebetween.

As can be seen best in FIG. 2, the valve 20 includes a reduced-thickness, lead-in section 28 at the lower end thereof. This lead-in section is approximately 0.060 to 0.070 inches in length, which is approximately 20% of the overall length of the valve 20.

Still referring to FIG. 2, the outer, or sealing surface 30 of the valve 20, located above, and joined to the lead-in section 28, is designed to provide a frictional leak-proof seal with container 12, in a manner which will be described hereinafter. However, it should be noted that a portion of the threaded section 26 constitutes a lead-in section, i.e., the threads thereof are engaged with corresponding threads on the finish of container 12, prior to establishing a frictional seal between the container and the outer sealing surface 30 of the valve 20.

Referring to the drawings, the container or bottle 12 includes a generally elongate, upper finish 40. Threads 42 are provided on the outer surface of the finish adjacent the top thereof. The finish also includes an inner surface 44 having an upper section **44*a*, a transition section 44*b*, extending inwardly and downwardly from the upper section 44*a*, and a lower seal section 44*c*, extending downwardly from the transition section 44*b*. It should be noted that the seal section 44*c* begins at junction 45 between the transition section 44*b* and the seal section 44*c*; approximately half way down the length of the finish, as measured from upper margin 46 of said finish. Specifically, the finish preferably has an elongate dimension of approximately 0.470 inches, and the junction of the transition section 44*b* with the seal section 44*c* is located approximately 0.216 inches from the upper margin 46**.

As can be seen best in FIG. 2, the threads 42 on the outer surface of the finish engage with lead-in threads adjacent the lower end of threaded section 26 of the closure 14, prior to the sealing surface 30 of the valve 20 frictionally engaging the sealing section **44*c* of the inner surface 44. Thereafter, further threaded rotation of the closure 14 on the finish 12, in a clockwise direction, moves the outer sealing surface 30 of the valve 20 axially downward into frictional, leak-tight engagement with the sealing section 44*c* of the inner surface 44, as shown at 47 in FIG. 1. The closure preferably is dimensioned so that an interference fit of at least 0.010 inches exists between the valve 20 of the closure 14, and the finish 40 of the container 12. That is, the diameter of the valve 20, as measured from its outer sealing surface 30, is at least 0.010 inches greater than the internal diameter of the finish, as measured in the region of the sealing section 44*c***.

By establishing the leak-proof seal in a region spaced downwardly from the upper margin 46 of the finish 44, applicant has discovered that the finish is substantially less susceptible to cracking, than is the case when a frictional, leak-proof seal is attempted to be established adjacent the upper margin 46 of the finish 12. It should be noted, in the most preferred embodiment of this invention, that the frictional sealing force is established in the finish, in a region below the threads 42 on the outer surface of said finish. That is, the inner sealing section **44*c* of the finish begins at the junction 45 of the transition section 44*b* with the seal section 44*c*, and this junction is located below the threads 42**.

Without further elaboration, the foregoing will so fully illustrate my invention, that others may, by applying current or future knowledge, adopt the same for use under various conditions of service.

I claim:

1. A package including a container and a closure, said container being a unitary, molded plastic member including an upper elongate finish having outer and inner surfaces, threads on the outer surface adjacent the upper margin of said finish, said inner surface having a lower sealing section located solely in a section of the finish spaced downwardly from said upper margin; said closure including an upper surface, an outer skirt extending downwardly from the upper surface and having threads on the inner surface thereof for threadedly engaging the threads on the finish, and an inner valve spaced concentrically within the outer skirt and extending axially downward from the upper surface of said closure, said inner valve having an outer surface for frictionally engaging only the lower sealing section of the inner finish surface in a region for creating a leak-proof seal between said container and closure; the outer surface of the finish opposite the region of frictional engagement between the inner valve member of the closure and the container being free of threads.

2. The package of claim 1 wherein the lower sealing section of the inner surface is connected to an upper section of said inner surface by an inwardly directed transition section.

3. The package of claim 2 wherein the transition section and the sealing section of the inner surface meet at a junction located downwardly from the upper margin of the finish a distance greater than 40% of the height of said finish.

4. The package of claim 3 wherein the threads on the outer surface of the finish terminate axially above the junction of the transition section and sealing section of the inner finish surface.

5. The package of claim 1 wherein threads on the inner surface of the skirt of the closure engage threads on the upper section of the finish prior to the outer sealing surface of the valve frictionally engaging the lower sealing section of the inner surface of the finish.

6. The package of claim 5 wherein the lower end of the inner valve of the closure has a reduced width lead-in section which moves adjacent to, but spaced radially out of engagement with the lower sealing section of the inner finish surface when threads on the inner surface of the closure skirt initially engage threads on the outer surface of the finish.

* * * * *